United States Patent [19]

Fish et al.

[11] Patent Number: 5,049,947

[45] Date of Patent: Sep. 17, 1991

[54] ROTATING BRUSH DECISION GATE

[75] Inventors: David J. Fish, Webster; Gerard R. Sturnick, Rochester; Peter A. Sardano, Fairport, all of N.Y.

[73] Assignee: Xerox Corporation, Stamford, Conn.

[21] Appl. No.: 375,180

[22] Filed: Jul. 3, 1989

[51] Int. Cl.[5] ..... G03G 21/00

[52] U.S. Cl. ..... 355/318; 271/186; 271/291; 271/902; 355/309; 355/319; 355/321

[58] Field of Search ..... 355/308, 309, 313, 318, 355/319, 321, 322; 271/902, 186, 291

[56] References Cited

U.S. PATENT DOCUMENTS

| | | | |
|---|---|---|---|
| 4,054,285 | 10/1977 | Stange et al. | 271/186 |
| 4,078,789 | 3/1978 | Kittredge et al. | 271/65 |
| 4,346,880 | 8/1982 | Roller et al. | 271/902 X |
| 4,359,217 | 11/1982 | Roller et al. | 271/902 X |
| 4,385,825 | 5/1983 | Kaneko | 355/319 |
| 4,420,153 | 12/1983 | Winkler et al. | 271/304 |
| 4,487,506 | 12/1984 | Repp et al. | 355/14 |
| 4,673,176 | 6/1987 | Schenk | 271/186 |
| 4,699,367 | 10/1987 | Russel | 271/902 X |
| 4,874,958 | 10/1989 | Sampath et al. | 355/319 X |

FOREIGN PATENT DOCUMENTS

| | | | |
|---|---|---|---|
| 0047181 | 3/1982 | European Pat. Off. | 355/318 |
| 0370783 | 5/1990 | European Pat. Off. . | |
| 3341413 | 5/1984 | Fed. Rep. of Germany | 271/186 |
| 2490608 | 3/1982 | France . | |
| 60-97161 | 5/1985 | Japan . | |
| 0018667 | 1/1986 | Japan | 271/186 |
| 61-51457 | 3/1986 | Japan . | |
| 61-162457 | 7/1986 | Japan . | |
| 0292165 | 12/1986 | Japan | 355/319 |
| 0264156 | 11/1987 | Japan | 271/186 |

OTHER PUBLICATIONS

Xerox Disclosure Journal, vol. 4, No. 3, "Paddle Wheel Inverter", D. N. Hawkins and G. J. Roller, May/Jun. 1979.

Xerox Disclosure Journal, David N. Hawkins et al., vol. 4, No. 3, May/Jun. 1979 titled "Bristle Roll Inverter".

IBM Technical Disclosure Bulletin, vol. 31, No. 8, Jan. 1989, pp. 379-380, New York, U.S.; "Duplexing for multi-width sheet requirements" *p. 380, paragaraph 2; figure*.

Patent Abstracts of Japan, vol. 10, No. 368 (M-543( [2425], Dec. 9, 1986; & JP-A-61 162457 (Fuji Xerox) 07-23-1986.

*Primary Examiner*—R. L. Moses

*Assistant Examiner*—Matthew S. Smith

[57] ABSTRACT

An automatic printing machine which forms an image on a sheet substrate has a multi-mode sheet output station in the form of a brush decision gate having a bidirectionally rotatable cylindrical fibrous brush to direct sheets upwardly over the top of the brush in a first sheet transport path when rotated in a counter clockwise direction and downwardly under the bottom of the brush in a second sheet transport path when rotated in a clockwise direction, the brush being selectively rotated in a clockwise and counter clockwise direction.

13 Claims, 4 Drawing Sheets

ROTATING BRUSH DECISION GATE

CROSS REFERENCE TO RELATED APPLICATION

Attention is hereby directed to our U.S. patent application Ser. No. 07/375,077 entitled "SHEET STACKER" filed concurrently herewith.

BACKGROUND OF THE INVENTION

The present invention relates to automatic printing machine and more particularly to a multi-mode print output station with a rotating brush decision gate for use with electrostatographic reproducing apparatus.

In an electrostatographic reproducing apparatus commonly in use today, a photoconductive insulating member is typically charged to a uniform potential and thereafter exposed to a light image of an original document to be reproduced. The exposure discharges the photoconductive insulating surface in exposed or background areas and creates an electrostatic latent image on the member which corresponds to the image areas contained within the usual document. Subsequently, the electrostatic latent image on the photoconductive insulating surface is made visible by developing the image with developing powder referred to in the art as toner. Most development systems employ a developer material which comprises both charged carrier particles and charged toner particles which triboelectrically adhere to the carrier particles. During development the toner particles are attracted from the carrier particles by the charge pattern of the image areas on the photoconductive insulating area to form a powder image on the photoconductive area. This image may subsequently be transferred to a support surface such as copy paper to which it may be permanently affixed by heating or by the application of pressure. Following transfer of the toner image to a support surface, the photoconductive insulating member is cleaned of any residual toner that may remain thereon in preparation for the next imaging cycle. Alternatively, the electrostatic latent image may be generated from information electronically stored or generated in digital form which afterwards may be converted to alphanumeric images by image generation, electronics and optics. In such a printer application a beam of light such as a laser beam may be used to selectively discharge the photoconductive.

The geometry of the processing component in many automatic reproducing machines is such that the copies produced have the image on the top side and sequential copies enter the collecting tray with the copy or image side up. This is satisfactory if only a single copy of a single image is desired or multiple copies of a single image is desired. In both cases no distinction between sequential copies is required and all copies may be readily collected with the image side up. It is also satisfactory if the original documents fed to the copying machine are fed in reverse order, last or bottom sheet first and first or top sheet last. In this instance, the collected set has the top sheet face up on top and the bottom sheet face up on the bottom of the set. However, in most instances of copying sets of documents, the set is face up with top sheet on the top of the set and copying according to normal procedures feeding the top document first, the top document number one, is copied producing a copy face up and set so produced has sheet number one face up on the bottom and the last sheet face up on the top. In addition in electronic printing it is advantageous to be able to print from the first page to the last page in order since if you print from the last page to the first page the substance of the first to the last pages must be stored in the printer's memory thereby increasing the size, cost and complexity of the memory required.

These difficulties may be avoided in the reproduction of successive sheets of a set by inverting each in the final set as it is collected face down with the top sheet on the bottom and the bottom sheet on the top. The Xerox 3700 copier and 2700 printers are examples of commercial applications of such inverters.

Typically, such inverters occupy a large amount of space which when accompanied with a high capacity stacker capable of stacking up to about 2,000 individual prints increases the overall machine volume required which when associated with the smaller low volume copiers and printers undesirably increases the size and thereby decreases customer acceptability.

Additionally, there has been the continuing desire to increase the capabilities of such printing apparatus and in particular to enable the stacking of simplex prints both 1 to N and N to 1 as well as duplex printing. This desire for increased functions has necessitated printer output stations having multi-mode capabilities. In the smaller, more compact printing machines this has generally resulted in the union of a relatively compact printing machine with a rather large cumbersome multi-mode output station. There has therefore, accordingly, been a desire and a need to provide a simple, compact, inexpensive output station with increased function and capabilities. Providing such a compact device is further complicated by the fact that in electrostatographic printing machines, the individual prints pass through a fuser to fuse the toner image to the print substrate by heating it to temperatures of the order of 200° to 225° resulting in varying degrees of curl within the finished print which in turn results in difficulties in transporting and stacking. In providing these increased functions and multi-mode capabilities typically a plurality of paper paths are required and a decision gate to direct the sheet substrate to one of a plurality of paper paths has typically taken the form of a solenoid actuated pivoting guide baffle as illustrated in the output station of U.S. Pat. No. 4,204,727 to Tates.

PRIOR ART

Xerox Disclosure Journal "Bristle Roll Inverter", Volume 4, Number 3, May/June 1979, page 331, to Hawkins and Roller discloses a sheet inverting device which includes a bristle roll which may rotate in either direction, the bristles themselves creating a contact with top and bottom guide walls. The bristles contact, and drive the lead edge of the paper to the output nip created by the bristles and the contact surface along the top or bottom wall, driving the sheet out.

Japanese Patent Application No. 61-162457 to Kayama discloses an automatic paper turn-over device which includes a turn-over chute and a three-roll arrangement. The middle roll is provided with stitches of artificial lawn serving as a slip preventing member.

SUMMARY OF THE INVENTION

In accordance with a principle aspect of the present invention, an automatic printing machine is provided with a multi-mode sheet output station comprising a bidirectional rotatable cylindrical fibrous brush decision gate to direct sheets upwardly over the top of the brush in a first sheet transport path when rotated in a counterclockwise direction and downwardly under the bottom of the brush in a second sheet transport path when rotated in a clockwise direction and means to selectively rotate the brush in a clockwise and counterclockwise direction.

In accordance with a further aspect of the present invention, the first and second sheet transport paths have at least one pair of bidirectionally rotatable nip rolls to selectively drive a sheet forward and backward through the nip.

In accordance with a further aspect of the present invention, the nip rolls in each of the first and second paths and the brush decision gate form therebetween a bidirectional sheet transport path between the nip rolls in the first and second paths.

In accordance with a further aspect of the present invention, sheet guide baffles are provided to guide a sheet being transported in each of the paths between rotatable brush and the baffle.

In a further aspect of the present invention, the brush decision gate comprises at least two rotatable cylindrical fibrous brushes axially mounted on a shaft and includes means to rotate the brushes at speed faster than the process speed of the printing machine.

In a further aspect of the present invention, the guide baffle in the second transport path has slots therein opposite each axially mounted brush; the ends of the fibers of the brush are in interference with the top lip of the slots so that when the brush is rotated clockwise, the reaction forces between the brush and the top lip pivot the brush down and when the brush is rotated counterclockwise the reaction forces between the brush and the top lip pivot the brush up.

In a further aspect of the present invention, the printing machine is an electrostatographic printing machine with a fuser roll and pressure roll forming a nip therebetween and the rotatable brush is adjacent the nip and pivotally mounted about the fuser roll.

In a further aspect of the present invention, the first sheet transport path terminates in an output catch tray adjacent to the pair of bidirectionally rotatable nip rolls to enable simplex (N−1) stacking or duplex (1−N) stacking in the tray.

In accordance with a further aspect of the present invention, the printing machine includes means to rotate the nip rolls to drive a sheet forward into the catch tray and includes means to reverse the direction of rotation of the nip rolls before the trail edge of a sheet being fed through the tray exit the nip rolls to enable the brush when rotating in a counterclockwise direction to direct the sheet through the bidirectional sheet transport path through the nip rolls in the second sheet transport path.

In a further aspect of the present invention, a generally horizontal stacking tray is provided at the output of the second pair of bidirectional rotatable nip rolls and includes means to turn a sheet into the stacking tray to enable simplex 1 to N stacking in the tray and means to rotate the nip rolls to drive a sheet forward into the stacking tray and including means to reverse the direction of rotation of the nip rolls before the trail edge of a sheet being fed to tray exit the nip rolls to enable the brush when rotating in a clockwise direction to direct the sheet through the bidirectional sheet transport path to the nip rolls in the first sheet transport path.

Other features of the present invention will become apparent as the following description proceeds and upon reference to the drawings.

DESCRIPTION OF THE PREFERRED EMBODIMENT

The invention will now be described with reference to a preferred embodiment of the multi-mode sheet output station with a rotating brush decision gate in an electrostatographic printing apparatus.

Figure 1:
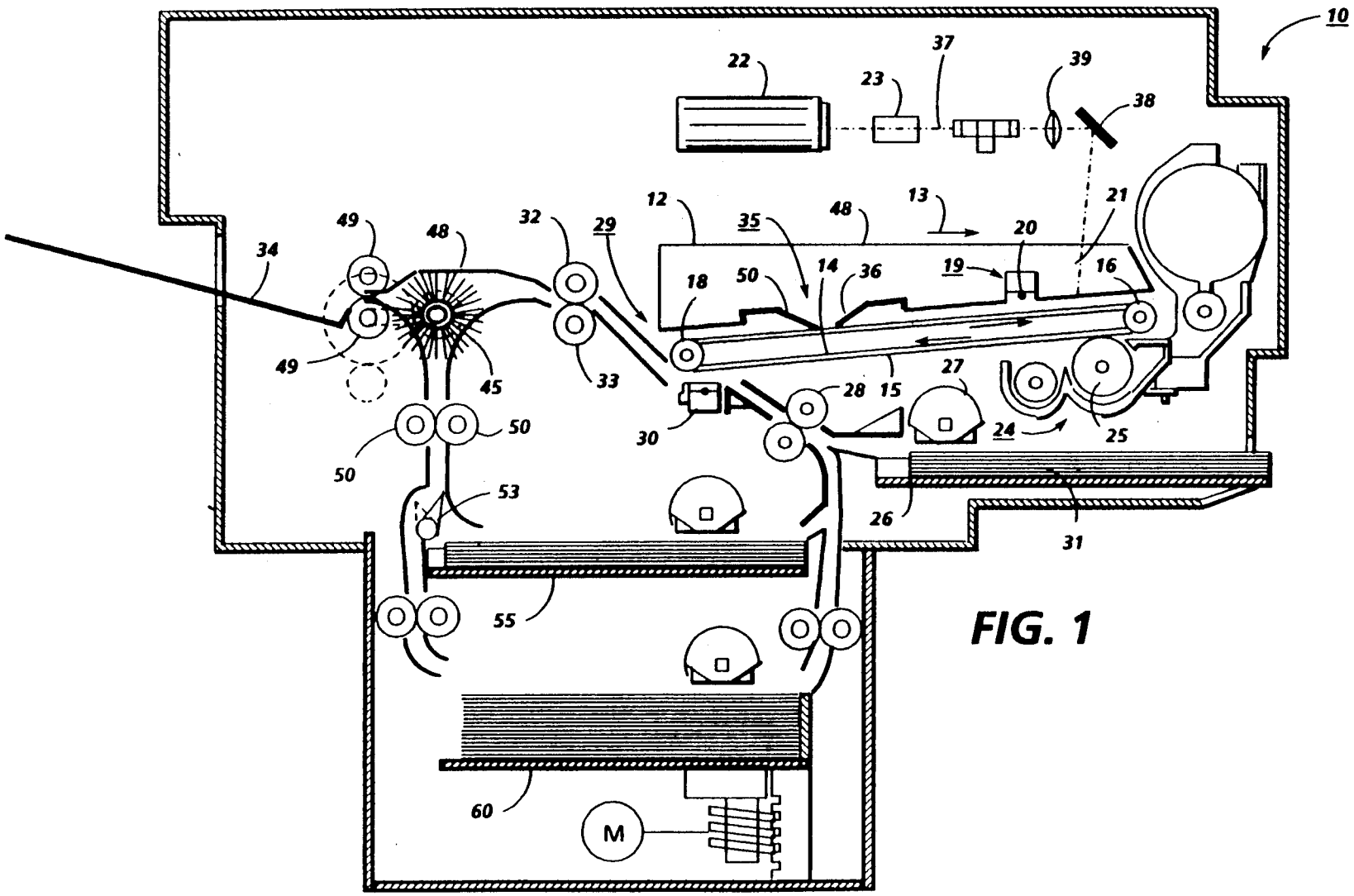
FIG. 1 is schematic representation in cross section of an automatic electrostatographic printing machine which may employ the rotating brush decision gate according to the present invention.

Referring now to FIG. 1, there is shown by way of example, an automatic electrostatographic reproducing machine 10 which includes a a multi-mode sheet output station with a rotating brush decision gate according to the present invention. The reproducing machine depicted in FIG. 1 illustrates the various components utilized therein for producing prints. Although the apparatus of the present invention is particularly well adapted for use in automatic electrostatographic reproducing machines, it should become evident from the following description that it is equally well suited for use in a wide variety of processing systems including other electrostatographic systems and is not necessarily limited in application to the particular embodiment or embodiment shown herein.

The printing machine 10 illustrated in FIG. 1 employs a removable processing cartridge 12 which may be inserted and withdrawn from the main machine frame in the direction of arrow 13. Cartridge 12 includes an image recording belt like member 14 the outer periphery of which is coated with a suitable photoconductive material 15. The belt is suitably mounted for revolution within the cartridge about driven transport roll 16, around idler roll 18 and travels in the direction indicated by the arrows on the inner run of the belt to bring the image bearing surface thereon past the plurality of xerographic processing stations. Suitable drive means such as a motor, not shown, are provided to power and coordinate the motion of the various cooperating machine components whereby a print of information is recorded upon a sheet of final support material 31, such as paper or the like.

Initially, the belt 14 moves the photoconductive surface 15 through a charging station 19 wherein the belt is uniformly charged with an electrostatic charge placed on the photoconductive surface by charge corotron 20 in known manner preparatory to imaging. Thereafter, the belt 14 is driven to exposure station 21 wherein the charged photoconductive surface 15 is exposed to light from raster output scanner which includes a suitable source of high intensity light such as laser 22 modulated in accordance with the content of the image signals as by an acoustic-optic modulator 23 to provide an imaging beam 37. Beam 37 is scanned across photoreceptor 14 at exposure station 21 by a scanning polygon 38 to expose the previously charged photoreceptor and create a latent electrostatic image of the document represented by the image signals input to modulator 23. Suitable optical means such as lens 39 is provided to focus beam 37 on photoreceptor 14.

Sheets 31 of the final support material are supported in a stack arranged on elevated stack support tray 26. With the stack at its elevated position, the sheet separator segmented feed roll 27 feeds individual sheets therefrom to the registration pinch roll pair 28. The sheet is then forwarded to the transfer station 29 in proper registration with the image on the belt and the developed image on the photoconductive surface 15 is brought into contact with the sheet 31 of final support material within the transfer station 29 and the toner image is transferred from the photoconductive surface 15 to the contacting side of the final support sheet 31 by means of transfer corotron 30. Following transfer of the image, the final support material which may be paper, plastic, etc., as desired, is separated from the belt by the beam strength of the support material 31 as it passes around the idler roll 18, and the sheet containing the toner image thereon is advanced to fixing station 41 wherein roll fuser 32 fixes the transferred powder image thereto. After fusing the toner image to the copy sheet the sheet 31 is advanced by output rolls 33 to sheet stacking tray 34.

Although a preponderance of toner powder is transferred to the final support material 31, invariably some residual toner remains on the photoconductive surface 15 after the transfer of the toner powder image to the final support material. The residual toner particles remaining on the photoconductive surface after the transfer operation are removed from the belt 14 by the cleaning station 35 which comprises a cleaning blade 36 in scrapping contact with the outer periphery of the belt 14 and contained within a cleaning housing which has a cleaning seal 50 associated with the upstream opening of the cleaning housing. Alternatively, the toner particles may be mechanically cleaned from the photoconductive surface by a cleaning brush as is well known in the art.

It is believed that the foregoing general description is sufficient for the purposes of the present application to illustrate the general operation of an automatic xerographic copier 10 which can embody the apparatus in accordance with the present invention.

Figure 2A:
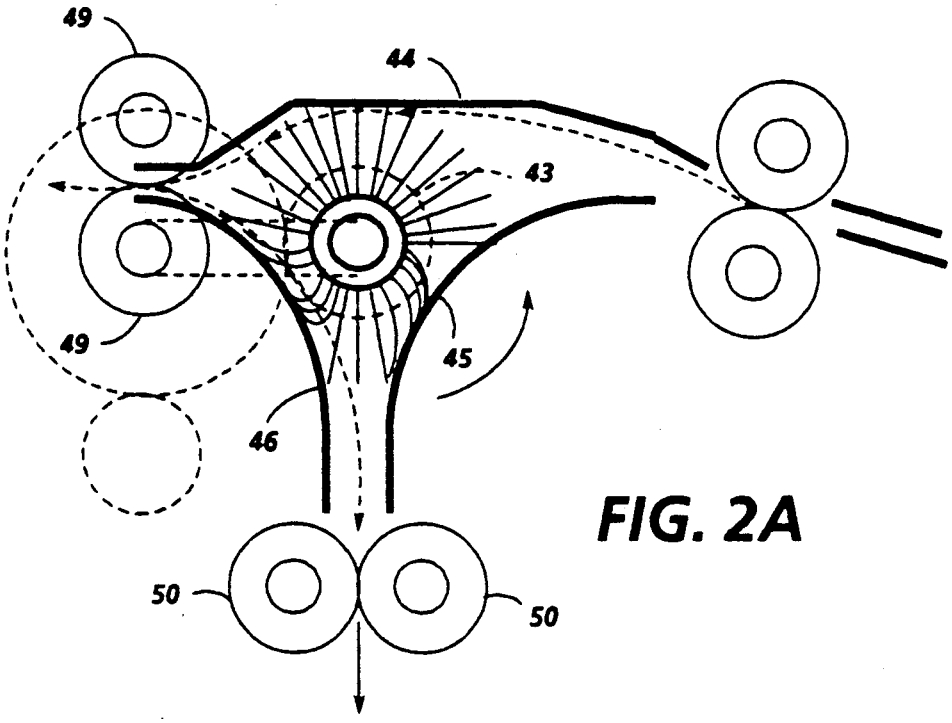
FIGS. 2A and 2B are enlarged sectional views of the rotating brush decision gate according to the present invention rotating in a counterclockwise and clockwise direction respectively.

With continued reference to FIG. 1 and additional reference to FIGS. 2A, 2B, 3 and 4, the rotating brush decision gate according to the present invention will be described in greater detail. As may be seen from FIG. 1 when a sheet substrate having a fused toner image exits the fuser nip formed between fuser roll 32 and pressure roll 33, it is driven into a bidirectionally rotatable cylindrical fibrous brush decision gate 43; the brush decision gate may be bidirectionally rotated such that if it is rotated in counterclockwise direction (FIG. 2A) as a sheet substrate leaves the fuser nip and enters the decision gate brush, the ends of the brush fibers urge the sheet substrate upwardly over the brush and direct the sheet substrate into a pair of bidirectionally rotatable nip rolls 49. A top guide baffle 44 is provided to guide the sheet substrate in the proper direction. Alternatively, if the rotatable cylindrical fibrous brush decision gate is rotated in a clockwise direction (FIG. 2B) as a sheet substrate exits the fuser nip and approaches the rotating brush, the lead edge of the sheet substrate will be directed downwardly toward a second pair of bidirectionally rotatable nip rolls 50. These post processor nip rolls 50 drive the sheet substrate into either a stacking tray 60 or into a duplex tray 55 equipped with a paper feeder 56 by feeding the sheet substrate through guide chute 52 where it may be selectively deflected from the stacker 60 by means of solenoid actuated deflector gate 53 into the duplex tray 55. The second sheet transport path is also provided with a transport baffle 45 to provide proper direction to the sheet and insure the appropriate driving force is placed on the sheet substrate. A bidirectional transport baffle 46 is provided to define together with the nip roll pairs 49 and 50 a bidirectional sheet transport path between the two nip rolls pairs. This enables, for example as illustrated in FIG. 2A, a sheet substrate to be directed over the top of the rotating brush toward the nip roll pair 49 and before its trail edge exits the nip roll pair 49 the direction of rotation of the nip roll pair be reversed and the sheet direction may then be reversed and urged by the counterclockwise rotating brush toward the nip roll pair 50. In a similar fashion with a clockwise rotating brush as illustrated in FIG. 2B, a sheet fed from the fuser will be directed downwardly toward the nip roll pair 50 whose direction is reversed prior to the trailing edge exiting the nip of roll pair 50 so that the trailing edge becomes the leading edge and is urged by the continuing clockwise rotation of the brush 43 toward the nip roll pair 49.

This provides a mechanism which is capable of directing paper in four separating operating modes as follows: from the fuser nip into the post processor nip 50, from the fuser nip into the output tray nip 49, from the output tray nip 49 into the post processor nip 50 and from the post processor nip 50 into the output tray nip 49. This enables the output station to support simplex 1 to N and N to 1 stacking to both the catch tray 34 and the stacker 60 as well as provide inversion of the paper for duplex. Thus with the brush rotating in the counterclockwise direction, the lead edge of the sheet substrate leaving the fuser nip is directed up over the brushes into the output nip rolls 49 for simplex N to 1 stacking or duplex 1 to N stacking. In this position, the sheet can also be stopped just prior to the trail edge entering the output nip and reverse in direction. The lead edge of the sheet previously the trail edge before the sheet direction was reversed now enters the counterclockwise rotating brush fibers which direct the paper downward into the post processor nip. This completes the inversion of the first pass of a duplex sheet. When the brush is rotated in a clockwise direction, the lead edge of the paper leaving the fuser nip is directed down under the brush into the post processor nip for simplex 1 to N stacking in the stacker. In this operating position, the sheet can also be stopped just prior to the trail edge entering the post processor nip and then reverse in direction. The lead edge of the sheet previously the trail edge before the sheet direction was reversed now enters the clockwise rotating brush fibers which direct the sheet to the left into the nip 49 into the output tray for 1 to N stacking.

Figure 2B:
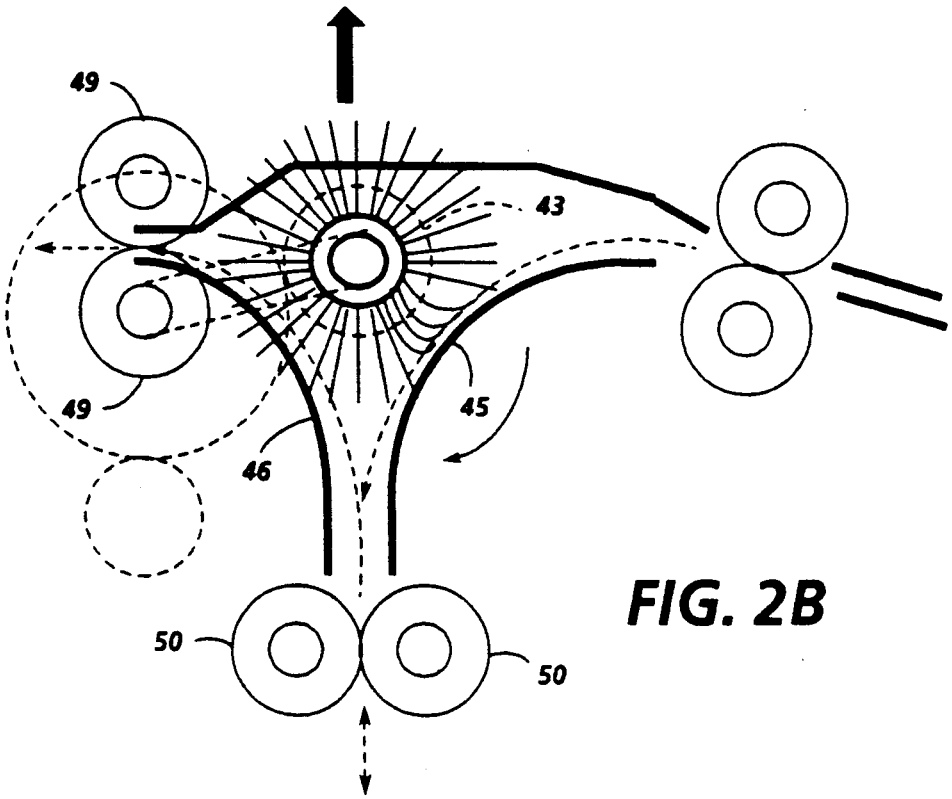
Figure 3:
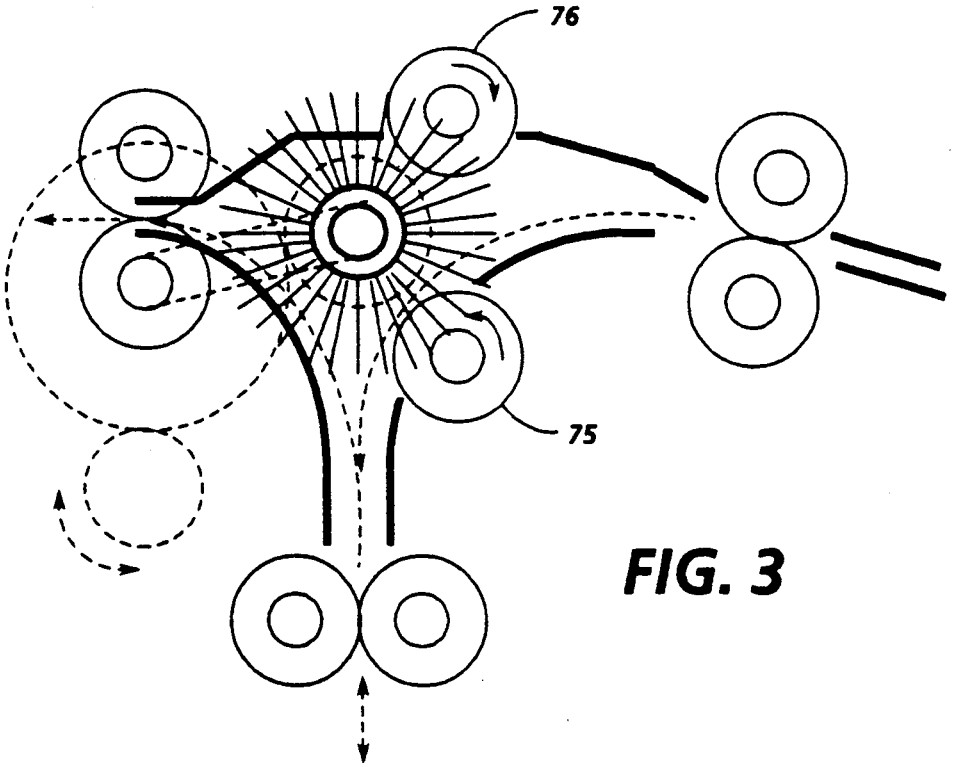
FIG. 3 is a sectional view of an alternative embodiment of the rotating brush decision gate according to the present invention.
Figure 4:
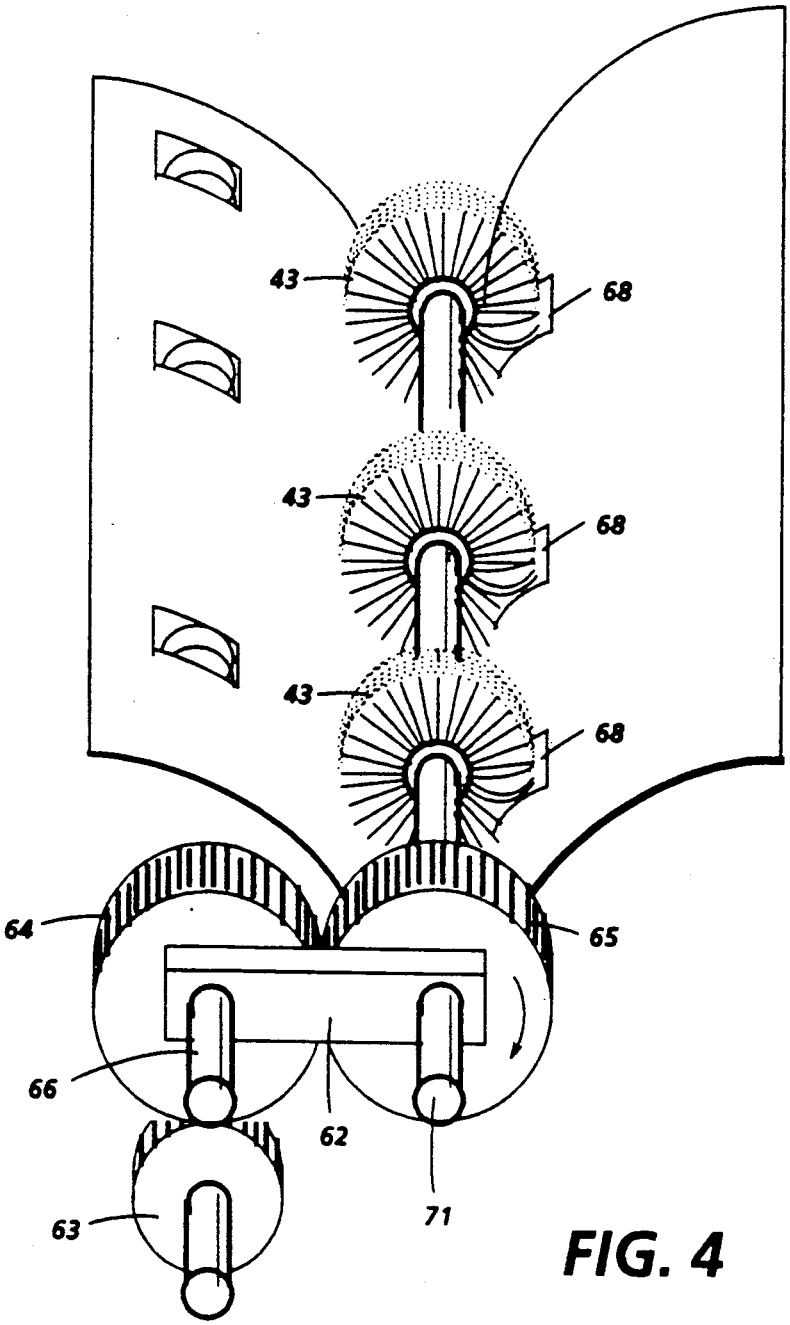
FIG. 4 is an isometric view of the embodiment of FIGS. 2A and 2B illustrating the reaction forces between the rotating brush and the top lip of the slot in the guide baffle.

With continued reference to FIGS. 1, 2, 3 and additional references to FIG. 4, the rotatable cylindrical fibrous brush decision gate comprises three cylindrical brushes axially mounted on a rotatable shaft 71 which is supported by pivot arm 62 about fixed axis 66 about which the shaft 71 pivots. Independent drive is imparted to the shaft 71 from a reversible motor (not shown) through gears 63, 64 and 65. The transport baffle 45 has slots 68 formed therein opposite each axially mounted brush and the ends of the fibers of the brush are in interference with the top lip of the slot so that when the brush is rotated clockwise as illustrated in FIGS. 2B and 4, the reaction forces between the brush and the top lip pivot the brush up and when the brush is rotated counterclockwise as illustrated in FIG. 2A the reaction forces between the brush and the top lip pivot the brush down. This embodiment has the advantage in minimizing the space required for the rotating brush assembly in that a smaller brush assembly may be employed which may be movable to the two operative positions.

The speed of rotation of the brush is significant in that it must be sufficient to impart a speed to the incoming sheet substrates in excess of the process speed of the printing apparatus in order to avoid the leading substrate being overtaken by a following substrate leading to a substrate jam. Furthermore, as is common in most printing machines having duplex capability where the sheet is driven in the first direction and reversed in direction to create the necessary inversion, it is important in maintaining acceptable print rate that the speed of delivery during the inversion is in effect more than twice the speed of the processor.

With specific reference to FIG. 3 an alternative embodiments is illustrated wherein the rotating brush 43 is stationary and does not change position with either clockwise or counterclockwise rotation. Also illustrated are driven rotatable rolls 75 and 76 in contact with the brush to form a drive nip therebetween.

The brushes may be made of any suitable material which is conductive and does not create static electricity to any significant extent but rather tends to drain off any static electricity generated and which does not create defects in the image. The diameter and length of the brush fibers are selected to provide the stiffness of the brush to enable it to urge incoming sheets along the transport path. Typically, the brushes are made of tufts of 6 mil nylon fibers which may be attached to the hub of the brush. In a typical configuration, 12 tufts of nylon fibers having a coefficient of friction with ordinary paper less than about 0.3 are mounted on a hub about 25 millimeters in diameter to provide a rotating brush about 45 millimeters in diameter.

Thus, according to the present invention a compact, inexpensive, highly reliable, multifunctional decision gate has been provided. It is a simple device providing both 1 to n and N to 1 simplex stacking in an offsetting catch tray and high capacity stacker as well as sheet inversion for duplex printing. Furthermore, with the use of a brush-type decision gate, the need for design and operational tolerances is very low compared to many other devices in that the brushes provide great flexibility in insuring the necessary direction and drive to the sheet substrates without requiring the precision contact of pinch rolls or rolls and baffles, for example. In addition, it has the advantage of being able to provide both lead edge and trail edge direction as well as being capable of dealing with a high degree of lead edge and trail edge curl in the sheet substrates emerging from the fuser nip.

The disclosure of the publications referred to herein is hereby specifically and totally incorporated herein by reference.

While the invention has been described with reference to specific embodiments, it will be apparent to those skilled in the art that many alternatives, modifications and variations may be made. Accordingly, it is intended to embrace all such alternative, modifications as may fall within the spirit and scope of the appended claims.

We claim:

1. An automatic printing machine comprising means to form an image on a sheet substrate at a given process speed and a multi-mode sheet output station comprising a brush decision gate having a bidirectionally rotatable cylindrical fibrous brush to direct sheets upwardly over the top of said brush in a first sheet transport path when rotated in a counter clockwise direction and downwardly under the bottom of said brush in a second sheet transport path when rotated in a clockwise direction and means to selectively rotate said brush in a clockwise and counter clockwise direction at a speed faster than the process speed of said printing machine and wherein each of said first and second paths has at least one pair of bidirectionally rotatable nip rolls to selectively drive a sheet forward and backward through said nip.

2. The printing machine of claim 1 wherein said nip rolls in each of said first and second paths and said brush decision gate form therebetween a bidirectional sheet transport path between said nip rolls in said first and second paths.

3. The printing machine of claim 2 including sheet guide baffles to guide a sheet being transported in each of said paths between the baffle and the brush.

4. The printing machine of claim 3 wherein said brush decision gate comprises at least two rotatable cylindrical fibrous brushes axially mounted on a shaft.

5. The printing machine of claim 4 wherein said shaft is pivotally mounted, the guide baffle in the second transport paths has slots therein opposite each axially mounted brush and the ends of the fibers of said brush are in interference with the top lip of the slot so that when the brush is rotated clockwise the reaction forces between the brush and the top lip pivot the brush down and when the brush is rotated counterclockwise, the reaction forces between the brush and the top lip pivot the brush up.

6. The printing machine of claim 5 wherein said printing machine is an electrostatographic printing machine with a fuser and a pressure roll forming a nip therebetween and said brush is adjacent said nip and pivotally mounted about said fuser roll.

7. The printing machine of claim 2 wherein said first sheet transport path terminates in an output catch tray adjacent to said pair of bidirectionally rotatable nip rolls in said first path to enable simplex $(N-1)$ stacking or duplex $(1-N)$ stacking in the tray.

8. The printing machine of claim 7 including means to rotate said nip rolls to drive a sheet forward into the catch tray and including means to reverse the direction of rotation of said nip rolls before the trail edge of a sheet being fed to the tray exits the nip rolls to enable said brush when rotating in the counterclockwise direction to direct said sheet through said bidirectional sheet transport path to the nip rolls in said second sheet transport path.

9. The printing machine of claim 2 further including a generally horizontal stacking tray at the output of said second pair of bidirectionally rotatable nip rolls and including means to turn a sheet into said stacking tray to enable simplex $(1-N)$ stacking in the tray.

10. The printing machine of claim 9 including means to rotate said nip rolls to drive a sheet forward into said stacking tray and including means to reverse the direction of rotation of said nip rolls before the trail edge of a sheet being fed to the tray exits the nip rolls to enable said brush when rotating in a clockwise direction to direct said sheet through said bidirectional sheet transport path to the nip rolls in said first sheet transport path.

11. The printing machine of claim 2 further including a duplex tray with sheet feeder at the output of said second pair of bidirectionally rotatable nip rolls.

12. The printing machine of claim 1 including sheet guide baffles to guide a sheet being transported in each of said paths between the rotatable brush and the baffle.

13. The printing machine of claim 1 wherein said brush decision gate comprises at least two rotatable cylindrical fibrous brushes axially mounted on a shaft.

* * * * *